US010444649B2

(12) United States Patent
Uemura

(10) Patent No.: US 10,444,649 B2
(45) **Date of Patent: *Oct. 15, 2019**

(54) TONER

(71) Applicant: KYOCERA Document Solutions Inc., Osaka (JP)

(72) Inventor: Hiroki Uemura, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/222,635

(22) Filed: Dec. 17, 2018

(65) Prior Publication Data

US 2019/0187579 A1 Jun. 20, 2019

(30) Foreign Application Priority Data

Dec. 20, 2017 (JP) ..... 2017-243978

(51) Int. Cl.
*G03G 9/08* (2006.01)
*G03G 9/093* (2006.01)

(52) U.S. Cl.
CPC ..... *G03G 9/09321* (2013.01); *G03G 9/09335* (2013.01); *G03G 9/09371* (2013.01)

(58) Field of Classification Search
CPC ..... G03G 9/09321; G03G 9/09371
USPC ..... 430/110.2
See application file for complete search history.

(56) References Cited

U.S. PATENT DOCUMENTS 10,303,073 B2 * 5/2019 Ogawa ..... G03G 9/09364

FOREIGN PATENT DOCUMENTS

JP 2015-125404 A 7/2015

* cited by examiner

*Primary Examiner* — Mark A Chapman
(74) *Attorney, Agent, or Firm* — Studebaker & Brackett PC

(57) ABSTRACT

A toner includes toner particles. The toner particles each include a composite core and a shell layer covering a surface of the composite core. The composite core is a composite of a toner core and organic particles located on a surface of the toner core. The toner core contains a releasing agent having a carboxyl group. The organic particles contain a resin having a carboxyl group and a mass average molecular weight of from 30,000 to 50,500. The shell layer includes a unit having a non-ring-opened oxazoline group. An amount of the non-ring-opened oxazoline group contained in 1 g of the toner as measured by gas chromatography-mass spectrometry is from 500 μmol to 1,400 μmol. An endothermic quantity due to melting of the releasing agent contained in 1 mg of the toner as measured by differential scanning calorimetry is from 80 mJ to 160 mJ.

11 Claims, 4 Drawing Sheets

TONER

INCORPORATION BY REFERENCE

The present application claims priority under 35 U.S.C. § 119 to Japanese Patent Application No. 2017-243978, filed on Dec. 20, 2017. The contents of this application are incorporated herein by reference in their entirety.

BACKGROUND

The present disclosure relates to a toner.

A known method for producing a toner includes for example causing polyester resin particles to aggregate in an aqueous medium to obtain aggregated particles.

SUMMARY

A toner according to the present disclosure includes toner particles. The toner particles each include a composite core and a shell layer covering a surface of the composite core. The composite core is a composite of a toner core and organic particles located on a surface of the toner core. The toner core contains a releasing agent having a carboxyl group. The organic particles contain a resin having a carboxyl group and a mass average molecular weight of at least 30,000 and no greater than 50,500. The shell layer includes a unit having a non-ring-opened oxazoline group. An amount of the non-ring-opened oxazoline group contained in 1 g of the toner as measured by gas chromatography-mass spectrometry is at least 500 μmol and no greater than 1,400 μmol. An endothermic quantity due to melting of the releasing agent contained in 1 mg of the toner as measured by differential scanning calorimetry is at least 80 mJ and no greater than 160 mJ.

DETAILED DESCRIPTION

Figure 1:
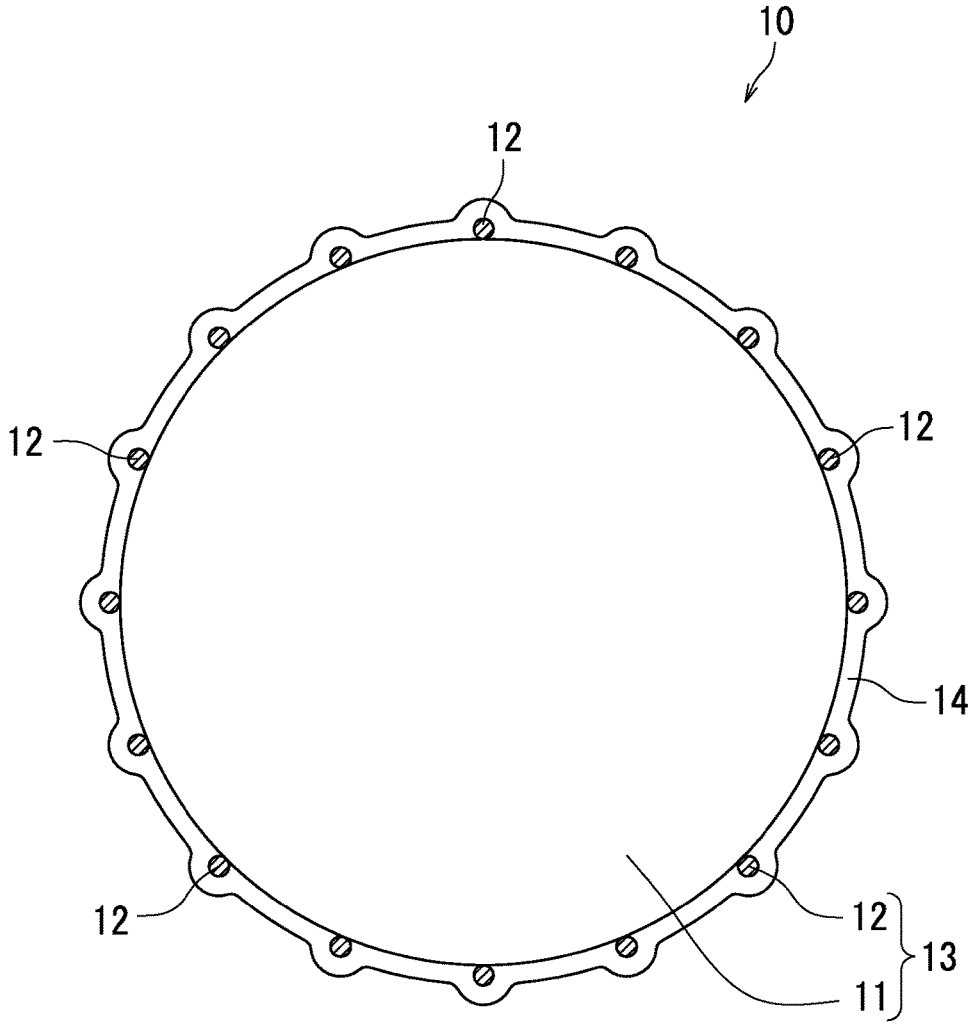
FIG. 1 is a diagram illustrating an example of a sectional structure of a toner particle included in a toner according to an embodiment of the present disclosure.

The following describes an embodiment of the present disclosure in detail. Note that evaluation results (values indicating shape, physical properties, or the like) for a powder (specific examples include toner cores, toner mother particles, an external additive, and a toner) are each a number average of values measured for an appropriate number of particles of the powder, unless otherwise stated. A number average particle diameter of a powder is a number average value of equivalent circle diameters of primary particles of the powder measured using a microscope, unless otherwise stated. An equivalent circle diameter is a Heywood diameter, which is a diameter of a circle having the same area as a projected area of a particle. A measured value for a volume median diameter ($D_{50}$) of a powder is a value measured based on the Coulter principle (electrical sensing zone method) using "COULTER COUNTER MULTISIZER 4" manufactured by Beckman Coulter, Inc., unless otherwise stated. A measured value for an acid value is a value measured in accordance with "Japanese Industrial Standard (JIS) K0070-1992", unless otherwise stated. Chargeability referred to herein is chargeability in triboelectric charging, unless otherwise stated. Strength of positive chargeability (or strength of negative chargeability) in triboelectric charging can be confirmed from a known triboelectric series. In the following description, the term "-based" may be appended to the name of a chemical compound in order to form a generic name encompassing both the chemical compound itself and derivatives thereof. When the term "-based" is appended to the name of a chemical compound used in the name of a polymer, the term indicates that a repeating unit of the polymer originates from the chemical compound or a derivative thereof. The term "(meth)acryl" is used as a generic term encompassing both acryl and methacryl. The following phrases "a chemical group optionally having a chemical group" and "a chemical group having a chemical group" respectively mean "a chemical group optionally substituted with a chemical group" and "a chemical group substituted with a chemical group". Also, the following phrases "a chemical group optionally having a substituent" and "a chemical group having a substituent" respectively mean "a chemical group optionally substituted with a substituent" and "a chemical group substituted with a substituent".

The present embodiment relates to a toner. The toner according to the present embodiment is excellent in fixability and heat-resistant preservability. Specifically, a toner excellent in fixability referred to herein is a toner that is excellent in low-temperature fixability, that can inhibit occurrence of document offset, and that can increase a fixable temperature range through inhibition of occurrence of hot offset. Document offset is a failure in which toner on a printed sheet of paper is attached to another sheet of paper. Hot offset is a failure in which toner is attached to a member (for example, a fixing device) of an image forming apparatus.

The toner according to the present embodiment includes toner particles. The toner is a mass of the toner particles. FIG. 1 illustrates an example of a sectional structure of a toner particle 10 included in the toner according to the present embodiment. The toner particle 10 illustrated in FIG. 1 includes a composite core 13 and a shell layer 14. The shell layer 14 covers a surface of the composite core 13. The composite core 13 is a composite of a toner core 11 and organic particles 12. The organic particles 12 are located on a surface of the toner core 11. The shell layer 14 covers for example the toner core 11 and the organic particles 12. Specifically, the shell layer 14 covers a surface region of the toner core 11 on which no organic particle 12 is present and surfaces of the organic particles 12. The shell layer 14 preferably substantially covers the entire surface region of the composite core 13, and more preferably completely covers the entire surface region of the composite core 13. The organic particles 12 are located between the toner core 11 and the shell layer 14 (i.e., at an interface therebetween). The organic particles 12 may protrude in a state in which the organic particles 12 are covered with the shell layer 14. Through the above, the structure of the toner particle included in the toner has been described with reference to FIG. 1. The following further describes the toner.

(ΔH of Toner)

An endothermic quantity due to melting of a releasing agent contained in 1 mg of the toner as measured by differential scanning calorimetry is at least 80 mJ and no greater than 160 mJ. In the following description, the "endothermic quantity due to melting of the releasing agent contained in 1 mg of the toner as measured by differential scanning calorimetry" may be referred to as "ΔH". In order to achieve both heat-resistant preservability and low-temperature fixability of the toner, the toner preferably has sharp meltability. ΔH of the toner of at least 80 mJ and no greater than 160 mJ can result in improvement in sharp meltability of the toner. ΔH of the toner of smaller than 80 mJ results in degradation of low-temperature fixability of the toner. ΔH of the toner of greater than 160 mJ results in degradation of heat-resistant preservability of the toner. It is also preferable that ΔH of the toner falls within a range between two values selected from 80 mJ, 82 mJ, 83 mJ, 157 mJ, 158 mJ, and 160 mJ.

Figure 2:
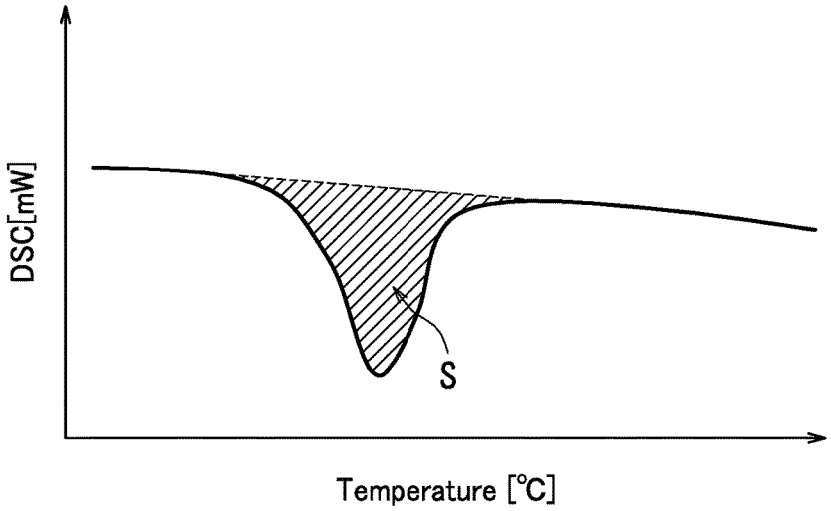
FIG. 2 is a graph representation showing a differential scanning calorimetry spectrum of the toner according to the embodiment of the present disclosure.

The following describes ΔH of the toner with reference to FIG. 2. The graph representation of FIG. 2 shows a differential scanning calorimetry spectrum of an example of the toner according to the present embodiment. Specifically, the graph representation of FIG. 2 shows a heat absorption curve plotted for the example of the toner according to the present embodiment in a second heat increase using a differential scanning calorimeter. A heating rate and a cooling rate are both 10° C./minute. In the graph representation of FIG. 2, the vertical axis indicates heat flow (DSC signal, unit: mW) and the horizontal axis indicates temperature (unit: ° C.). ΔH of the toner (specifically, the endothermic quantity due to melting of the releasing agent contained in 1 mg of the toner) can be determined from an area S of an endothermic peak in FIG. 2, which peak is derived from the releasing agent (specifically, generated by melting of the releasing agent) contained in 1 mg of the toner. ΔH of the toner is measured by a method described later in Examples or an alternative method thereof.

ΔH of the toner can be adjusted for example by changing an amount of a releasing agent contained in the toner cores. ΔH of the toner increases with an increase in the amount of the releasing agent contained in the toner cores. Also, ΔH of the toner can be adjusted for example by changing an amount of a binder resin contained in the toner cores.

(Relationship Between Storage Elastic Modulus and Temperature of Toner)

Figure 3:
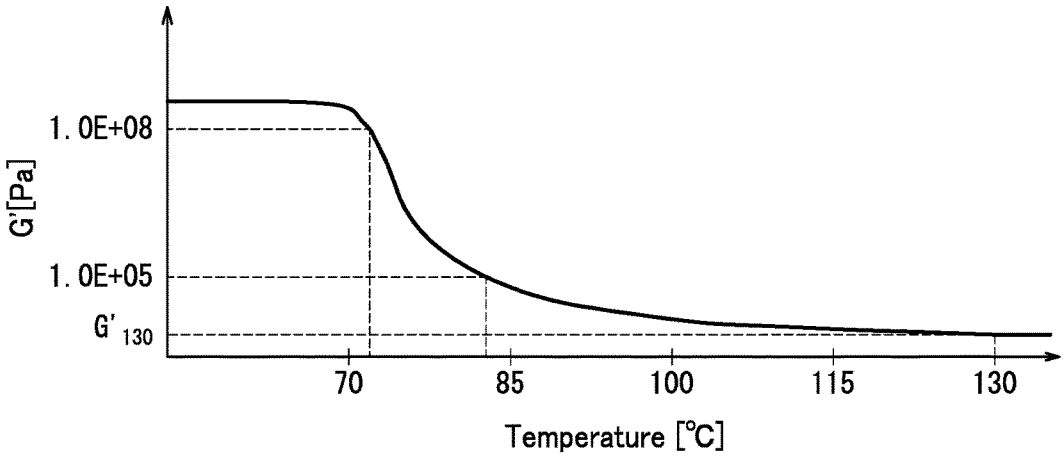
FIG. 3 is a graph representation showing a G' temperature dependence curve of the toner according to the embodiment of the present disclosure.

The following describes a relationship between storage elastic moduli G' and temperatures of the toner with reference to FIG. 3. The graph representation of FIG. 3 shows a G' temperature dependence curve of an example of the toner according to the present embodiment. Specifically, the G' temperature dependence curve shown in FIG. 3 is plotted using a rheometer by increasing the temperature of the toner at a constant rate (heating rate: 4° C./minute) and measuring storage elastic moduli G' of the toner at respective temperatures. In the graph representation of FIG. 3, the vertical axis indicates storage elastic modulus G' (unit: Pa) and the horizontal axis indicates temperature (unit: ° C.) of the toner. In the G' temperature dependence curve shown in FIG. 3, the storage elastic modulus decreases with an increase in the temperature of the toner.

In order to achieve both heat-resistant preservability and low-temperature fixability of the toner, the toner preferably has sharp meltability. In order that the toner has sharp meltability, it is preferable that a temperature of the toner when the storage elastic modulus of the toner is $1.0\times10^8$ Pa is at least 70° C. and a temperature of the toner when the storage elastic modulus of the toner is $1.0\times10^5$ Pa is no higher than 85° C. A toner having the above features has sufficiently high storage elastic moduli at temperatures equal to or lower than 70° C. However, when the toner is heated in fixing, the storage elastic modulus of the toner sharply decreases and becomes sufficiently small when the temperature of the toner reaches 85° C. For example, as shown in FIG. 3, a temperature of the toner when the storage elastic modulus of the toner is $1.0\times10^8$ Pa is at least 70° C. and a temperature of the toner when the storage elastic modulus of the toner is $1.0\times10^5$ Pa is no higher than 85° C. The toner having sharp meltability as above tends to be excellent in both heat-resistant preservability and low-temperature fixability.

A temperature of the toner when the storage elastic modulus of the toner is $1.0\times10^8$ Pa is preferably at least 70° C. and no higher than 80° C., and more preferably at least 70° C. and no higher than 76° C. It is also preferable that the temperature of the toner when the storage elastic modulus of the toner is $1.0\times10^8$ Pa falls within a range between two values selected from 70° C., 71° C., 72° C., 73° C., 74° C., 75° C., and 76° C.

A temperature of the toner when the storage elastic modulus of the toner is $1.0\times10^5$ Pa is preferably at least 70° C. and no higher than 85° C., more preferably at least 80° C. and no higher than 85° C., and further preferably at least 82° C. and no higher than 85° C. It is also preferable that the temperature of the toner when the storage elastic modulus of the toner is $1.0\times10^5$ Pa falls within a range between two values selected from 70° C., 82° C., 83° C., 84° C., and 85° C.

Respective temperatures of the toner when the storage elastic modulus of the toner is $1.0\times10^8$ Pa and when the storage elastic modulus of the toner is $1.0\times10^5$ Pa are each measured by a method described later in Examples or an alternative method thereof.

The respective temperatures of the toner when the storage elastic modulus of the toner is $1.0\times10^8$ Pa and when the storage elastic modulus of the toner is $1.0\times10^5$ Pa can each be adjusted for example by changing a glass transition point of the toner. In order that the toner has sharp meltability, the toner preferably has a glass transition point of at least 65° C. and no higher than 70° C. The glass transition point of the toner may fall within a range between two values selected from 65° C., 66° C., 67° C., 68° C., 69° C., and 70° C. The glass transition point of the toner may be 66° C., 67° C. 68° C., or 70° C. The glass transition point of the toner can be adjusted for example by changing either or both of a melting point of the binder resin and a melting point of the releasing agent. Also, the glass transition point of the toner can be adjusted for example by changing a mass of the releasing agent relative to a mass of the binder resin. In a configuration in which the toner cores contain no binder resin, the glass transition point of the toner can be adjusted for example by changing the melting point of the releasing agent.

In order to improve elasticity of the toner, a storage elastic modulus of the toner when the temperature of the toner is 130° C. (hereinafter may be referred to as "$G'_{130}$ of the toner") is preferably at least $1.0\times10^4$ Pa and no greater than $5.0\times10^4$ Pa. When $G'_{130}$ of the toner is at least $1.0\times10^4$ Pa and no greater than $5.0\times10^4$ Pa, the toner has adequate elasticity. When $G'_{130}$ of the toner is at least $1.0\times10^4$ Pa, elasticity of the toner becomes adequately high. When the toner has adequately high elasticity, the toner is readily detached from a member (for example, a fixing device) of the image forming apparatus, resulting in inhibition of occurrence of hot offset. As a result, a fixable temperature range of the toner increases. Also, occurrence of document offset can be inhibited. When $G'_{130}$ of the toner is no greater than $5.0\times10^4$ Pa, elasticity of the toner does not become excessively high, resulting in improvement in low-temperature fixability of the toner.

In order to achieve both increase in the fixable temperature range of the toner and improvement in low-temperature fixability of the toner in a well-balanced manner, $G'_{130}$ of the toner is preferably at least $1.0\times10^4$ Pa and no greater than $4.5\times10^4$ Pa, and more preferably at least $1.3\times10^4$ Pa and no greater than $4.5\times10^4$ Pa. For the same purpose, it is also preferable that $G'_{130}$ of the toner falls within a range between two values selected from $1.0\times10^4$ Pa, $1.3\times10^4$ Pa, $2.0\times10^4$ Pa, $2.2\times10^4$ Pa, $2.3\times10^4$ Pa, $3.5\times10^4$ Pa, $3.7\times10^4$ Pa, $4.5\times10^4$ Pa, and $5.0\times10^4$ Pa.

$G'_{130}$ of the toner is measured by a method described later in Examples or an alternative method thereof. $G'_{130}$ of the toner can be adjusted for example by changing a mass average molecular weight of the organic particles.

(Non-Ring-Opened Oxazoline Group Content)

The shell layers of the toner according to the present embodiment include a unit having a non-ring-opened oxazoline group. An amount of the non-ring-opened oxazoline group contained in 1 g of the toner according to the present embodiment as measured by gas chromatography-mass spectrometry is at least 500 μmol and no greater than 1,400 mol. In the following description, the "amount of the non-ring-opened oxazoline group contained in 1 g of the toner as measured by gas chromatography-mass spectrometry" may be referred to as a "non-ring-opened oxazoline group content". The non-ring-opened oxazoline group content is measured by a method described later in Examples or an alternative method thereof.

When the non-ring-opened oxazoline group content is smaller than 500 μmol, the toner contains a small amount of the shell layers, resulting in degradation of heat-resistant preservability of the toner. By contrast, when the non-ring-opened oxazoline group content is greater than 1,400 μmol, the toner contains a large amount of the shell layers, resulting in degradation of low-temperature fixability of the toner. When the non-ring-opened oxazoline group content is at least 500 μmol and no greater than 1,400 μmol, the following advantage is thought to be achieved. As the non-ring-opened oxazoline group content increases, a strong bond (specifically, an amide bond) tends to be formed between the composite core and the shell layer. However, when the non-ring-opened oxazoline group content in the toner is excessively large, the toner tends to have excessively strong positive chargeability. When the non-ring-opened oxazoline group content in the toner is at least 500 μmol and no greater than 1,400 μmol, the entire surface region of the composite core can be covered with the shell layer while the toner is rendered adequately positively chargeable. Even when a large amount of the releasing agent is contained in the toner cores, the shell layers can be secured to the surfaces of the toner cores with sufficient bonding strength through the strong bond (specifically, the amide bond).

The non-ring-opened oxazoline group content is preferably at least 510 μmol and no greater than 1,350 μmol, and more preferably at least 565 μmol and no greater than 1,320 μmol. It is also preferable that the non-ring-opened oxazoline group content falls within a range between two values selected from 500 μmol, 505 μmol, 508 μmol, 510 μmol, 565 μmol, 1,320 μmol, and 1,400 μmol.

The non-ring-opened oxazoline group content can be adjusted for example by changing an amount of a material for forming the shell layers (hereinafter may be referred to as a shell material) relative to a mass of the toner cores. Also, the non-ring-opened oxazoline group content can be adjusted for example by changing an amount of the shell material relative to a mass of the organic particles. Also, the non-ring-opened oxazoline group content can be adjusted for example by causing ring-opening of some of non-ring-opened oxazoline groups contained in the shell layers with a ring-opening agent.

Here, it is noted that ΔH of the toner according to the present embodiment is at least 80 mJ and no greater than 160 mJ. An amount of the releasing agent contained in the toner tends to increase with an increase in ΔH of the toner. In a typical toner, a binder resin accounts for a main proportion (for example, approximately 90% by mass) of toner particles, and one or more internal additives account for the rest (for example, approximately 10% by mass) of the toner particles (for example, a releasing agent accounts for 5% by mass and a colorant accounts for 5% by mass). A toner having ΔH of at least 80 mJ and no greater than 160 mJ tends to contain a releasing agent in an amount of from 10 to 20 times of that of a releasing agent contained in a typical toner. Such a large amount of the releasing agent imparts sharp meltability to the toner. However, when the toner particles contain a large amount of the releasing agent, the releasing agent tends to be detached from the toner particles. Also, the large amount of the releasing agent tends to increase adhesiveness of surfaces of the toner particles. When the surfaces of the toner particles have increased adhesiveness, the toner tends to adhere to a member (specific examples include a carrier, a photosensitive drum, and a development roller) located within the image forming apparatus. Such adhesion of the toner causes an image defect. Also, when the toner particles contain an excessively large amount of the releasing agent, meltability of the toner particles becomes excessively high.

The present inventor considered inhibiting detachment of the releasing agent and adhesion of the toner as described above by covering the surfaces of the toner cores containing a large amount of the releasing agent with the shell layers. However, it was not easy to secure the shell layers to the toner cores containing a large amount of the releasing agent with sufficient bonding strength.

The present inventor focused on a fact that a chemical bond (a covalent bond) can be formed between the toner cores and the shell layers when the toner cores contain a releasing agent having a carboxyl group and the shell layers include a unit having a non-ring-opened oxazoline group. Also, the present inventor focused on a fact that a chemical bond (a covalent bond) can be formed between organic particles and the shell layers when organic particles having a carboxyl group are located on the surfaces of the toner cores and the shell layers include the unit having the non-ring-opened oxazoline group. As a result, the present inventor succeeded in covering the surfaces of the toner cores containing a large amount of the releasing agent with the shell layers. As a consequence of the surfaces of the toner cores being covered with the shell layers, both detachment of the releasing agent and adhesion of the toner as described above could be inhibited. The presence of the shell layers prevents exposure of the releasing agent at surfaces of the toner mother particles.

A preferable example of the unit having the non-ring-opened oxazoline group is a unit represented by formula (A) shown below. In the following description, the unit represented by formula (A) may be referred to as a "unit (A)".

(A)

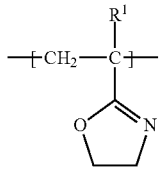

In formula (A), $R^1$ represents a hydrogen atom or an alkyl group optionally having a substituent. Examples of alkyl groups represented by $R^1$ include a methyl group, an ethyl group, and an isopropyl group. In a case where $R^1$ represents an alkyl group having a substituent, examples of the substituent include a phenyl group. Preferable examples of chemical groups represented by $R^1$ include a hydrogen atom, a methyl group, an ethyl group, and an isopropyl group.

When oxazoline groups of some units (A) among a plurality of units (A) included in the shell layers are reacted with carboxyl groups of the releasing agent contained in the toner cores, the shell layers including the units (A) can further include units each represented by formula (B1) shown below. In the following description, a unit represented by formula (B1) may be referred to as a "unit (B1)".

(B1)

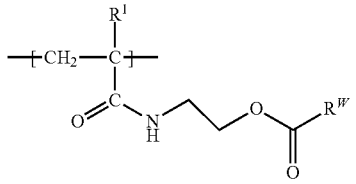

In formula (B1), $R^1$ represents the same chemical group as that represented by $R^1$ in formula (A), and $R^W$ represents an atom of the releasing agent contained in the toner cores. $R^W$ represents a constituent atom of the releasing agent, which constituent atom is bonded to a carboxyl group.

When oxazoline groups of some units (A) among the plurality of units (A) included in the shell layers are reacted with carboxyl groups of a resin contained in the organic particles, the shell layers including the units (A) can further include units each represented by formula (B2) shown below. In the following description, a unit represented by formula (B2) may be referred to as a "unit (B2)".

(B2)

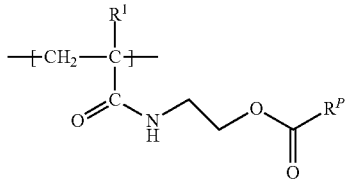

In formula (B2), $R^1$ represents the same chemical group as that represented by $R^1$ in formula (A), and $R^P$ represents an atom of the resin contained in the organic particles. $R^P$ represents a constituent atom of the resin contained in the organic particles, which constituent atom is bonded to a carboxyl group.

The units (A) each have a non-ring-opened oxazoline group. The non-ring-opened oxazoline group has a cyclic structure and has strong positive chargeability. The non-ring-opened oxazoline group readily reacts with a carboxyl group, an aromatic sulfanyl group, and an aromatic hydroxyl group. For example, when the unit (A) included in the shell layer reacts with a carboxyl group of the releasing agent (represented by $R^W$ in formula (B1)) contained in the toner core, the oxazoline group is ring-opened as shown in formula (B1) to form an amide bond. Also, when the unit (A) included in the shell layer reacts with a carboxyl group of the resin (represented by $R^P$ in formula (B2)) contained in the organic particle, the oxazoline group is ring-opened as shown in formula (B2) to form an amide bond. As a result of formation of strong bonds (specifically, the amide bonds) between the composite cores and the shell layers, detachment of the shell layers from the composite cores is inhibited. Also, as a result of formation of strong bonds (specifically, the amide bonds) between the composite cores and the shell layers, detachment of the organic particles from the toner particles is inhibited. Note that the oxazoline group loses positive chargeability through ring-opening thereof.

A ring-opening agent may for example be used for causing ring-opening of oxazoline groups of some units (A) among the plurality of units (A) included in the shell layers. As the ring-opening agent, a carboxylic acid is preferable, a carboxylic acid represented by $R^2$—COOH is more preferable, and acetic acid or propionic acid is further preferable. Note that $R^2$ in "$R^2$—COOH" represents the same chemical group as that represented by $R^2$ in formula (C) shown below. Through use of such a ring-opening agent, the shell layers including the unit (A), the unit (B1), and the unit (B2) can further include units each represented by formula (C) shown below. In the following description, a unit represented by formula (C) may be referred to as a "unit (C)".

(C)

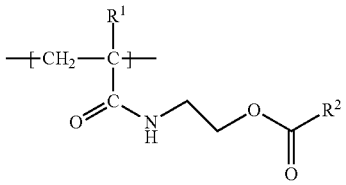

In formula (C), $R^1$ represents the same chemical group as that represented by $R^1$ in formula (A), and $R^2$ represents an alkyl group optionally having a substituent. $R^2$ preferably represents an alkyl group, more preferably represents a straight-chain alkyl group having a carbon number of at least 1 and no greater than 6, and particularly preferably represents a methyl group or an ethyl group. When acetic acid is used as the ring-opening agent for the oxazoline groups, $R^2$ represents a methyl group.

The toner cores of the toner according to the present embodiment contain a large amount of the releasing agent. Therefore, even in a configuration in which the toner cores contain no binder resin, the toner can be suitable for use in image formation. However, the binder resin may be contained in the toner cores for the purpose of obtaining a toner excellent in adhesion between the toner cores and the shell layers and excellent in heat-resistant preservability.

For example, when the toner cores contain a binder resin having a carboxyl group, the shell layers including the unit (A), the unit (B1), and the unit (B2) can further include a unit represented by formula (D) shown below. In the following description, the unit represented by formula (D) may be referred to as a "unit (D)". The shell layers may further include the above-described unit (C) in addition to the unit (A), the unit (B1), the unit (B2), and the unit (D).

(D)

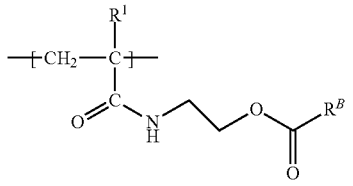

In formula (D), $R^1$ represents the same chemical group as that represented by $R^1$ in formula (A), and $R^B$ represents an atom of the binder resin contained in the toner cores.

When the unit (A) included in the shell layer reacts with the carboxyl group of the binder resin (represented by $R^B$ in formula (D)) contained in the toner core, the oxazoline group is ring-opened as shown in formula (D) to form an amide bond. As a result of formation of strong bonds (specifically, the amide bonds) between the toner cores and the shell layers, detachment of the shell layers from the toner cores is inhibited.

Formation of the units (B1), (B2), (C), and (D) through ring-opening of the units (A) included in the shell layers can be confirmed for example by the following method. Specifically, a specific amount of the toner particles (sample) is dissolved in a solvent. The resultant solution is placed in a test tube for nuclear magnetic resonance (NMR) measurement, and a $^1$H-NMR spectrum is measured using a NMR device.

Here, it is known that a triplet signal derived from a secondary amide appears around a chemical shift δ of 6.5 in a $^1$H-NMR spectrum. Accordingly, when a triplet signal appears around a chemical shift δ of 6.5 in the measured $^1$H-NMR spectrum, it is inferred that any of the units (B1), (B2), (C), and (D) is formed through ring-opening of the units (A) included in the shell layers. The $^1$H-NMR spectrum is measured for example under the following conditions.

(Exemplary Conditions of $^1$H-NMR Spectrum Measurement)

NMR device: Fourier transform nuclear magnetic resonance (FT-NMR) device ("JNM-AL400" manufactured by JEOL Ltd.)

Test tube for NMR measurement: 5-mm test tube

Solvent: deuterated chloroform (1 mL)

Sample temperature: 20° C.

Sample mass: 20 mg

Cumulative number of times: 128 times

Internal standard substance for chemical shift: tetramethylsilane (TMS)

A proportion of an amount of the releasing agent relative to a mass of the toner cores is preferably at least 60% by mass and no greater than 95% by mass. When the mass of the toner cores is for example 100 g, the mass of the releasing agent contained in the toner cores is preferably at least 60 g and no greater than 95 g. The proportion of the amount of the releasing agent relative to the mass of the toner cores is more preferably at least 90% by mass and no greater than 95% by mass, and further preferably at least 91% by mass and no greater than 94% by mass.

Preferably, the toner cores contain the releasing agent and a colorant and contain no binder resin. In a configuration in which the toner cores contain no binder resin, the proportion of the amount of the releasing agent relative to the mass of the toner cores is preferably at least 90% by mass and no greater than 95% by mass, and more preferably at least 91% by mass and no greater than 94% by mass.

Typically, toner cores are roughly classified into pulverized cores (also called pulverized toner) and polymerized cores (also called chemical toner). Toner cores obtained by a pulverization method belong to the pulverized cores and toner cores obtained by an aggregation method belong to the polymerized cores. The toner cores of the toner according to the present embodiment are preferably polymerized cores. In order to ensure that the toner has sufficient low-temperature fixability, the toner cores preferably include no oxazoline group. In terms of producibility of the toner, the toner cores preferably contain no crystalline polyester resin, and more preferably contain no binder resin. Even in a configuration in which the toner cores contain no binder resin (for example, crystalline polyester resin), the toner according to the present embodiment can have sharp meltability owing to the large amount of the releasing agent contained in the toner cores. In order that the toner can be suitable for use in image formation, the toner preferably has a volume median diameter ($D_{50}$) of at least 4 μm and no greater than 9 μm.

The following further describes the toner cores, the shell layers, the organic particles, and an external additive. Inessential components may be omitted according to an intended use of the toner.

[Toner Cores]

(Binder Resin)

The toner cores may contain a binder resin. In order to increase bondability (reactivity) between the toner cores and the shell layers, the binder resin preferably has an acid value of at least 10 mgKOH/g.

Examples of the binder resin include styrene-based resins, acrylic acid-based resins (specific examples include acrylic acid ester polymers and methacrylic acid ester polymers), olefin-based resins (specific examples include polyethylene resins and polypropylene resins), vinyl chloride resins, polyvinyl alcohols, vinyl ether resins, N-vinyl resins, polyester resins, polyamide resins, and urethane resins. Copolymers of the above-listed resins, that is, copolymers obtained through incorporation of a repeating unit into the above-listed resins (specific examples include styrene-acrylic acid-based resins and styrene-butadiene-based resins) can also be used.

(Colorant)

The toner cores may contain a colorant. A known pigment of dye that matches the color of the toner can be used as the colorant. In order that the toner can be suitable for use in image formation, an amount of the colorant relative to the mass of the toner cores is preferably at least 1% by mass and no greater than 20% by mass.

The toner cores may contain a black colorant. An example of the black colorant is carbon black. Alternatively, a colorant adjusted to black color using a yellow colorant, a magenta colorant, and a cyan colorant may be used as the black colorant.

The toner cores may contain a non-black colorant. Examples of the non-black colorant include a yellow colorant, a magenta colorant, and a cyan colorant.

The yellow colorant that can be used is for example at least one compound selected from the group consisting of condensed azo compounds, isoindolinone compounds, anthraquinone compounds, azo metal complexes, methine compounds, and arylamide compounds. Specific examples of the yellow colorant include C.I. Pigment Yellow (3, 12, 13, 14, 15, 17, 62, 74, 83, 93, 94, 95, 97, 109, 110, 111, 120, 127, 128, 129, 147, 151, 154, 155, 168, 174, 175, 176, 180, 181, 191, or 194), Naphthol Yellow S, Hansa Yellow G, and C.I. Vat Yellow.

The magenta colorant that can be used is for example at least one compound selected from the group consisting of condensed azo compounds, diketopyrrolopyrrole compounds, anthraquinone compounds, quinacridone compounds, basic dye lake compounds, naphthol compounds, benzimidazolone compounds, thioindigo compounds, and perylene compounds. Specific examples of the magenta colorant include C.I. Pigment Red (2, 3, 5, 6, 7, 19, 23, 48:2, 48:3, 48:4, 57:1, 81:1, 122, 144, 146, 150, 166, 169, 177, 184, 185, 202, 206, 220, 221, or 254).

The cyan colorant that can be used is for example at least one compound selected from the group consisting of copper phthalocyanine compounds, anthraquinone compounds, and basic dye lake compounds. Specific examples of the cyan colorant include C.I. Pigment Blue (1, 7, 15, 15:1, 15:2, 15:3, 15:4, 60, 62, or 66), Phthalocyanine Blue, C.I. Vat Blue, and C.I. Acid Blue.

(Releasing Agent)

The toner cores of the toner according to the present embodiment contain a releasing agent having a carboxyl group. The releasing agent having a carboxyl group is preferably a wax having a carboxyl group. Examples of waxes having a carboxyl group include an ester wax, a polyethylene wax, a polypropylene wax, a fluororesin wax, a Fischer-Tropsch wax, a paraffin wax, and a montan wax. One releasing agent may be used independently, or two or more releasing agents may be used in combination.

The releasing agent having a carboxyl group is preferably an ester wax (more specifically, a synthetic ester wax or a natural ester wax), and more preferably a synthetic ester wax. When the synthetic ester wax is used as the releasing agent, the melting point of the releasing agent can be easily adjusted to fall within a desired range. The synthetic ester wax can be synthesized for example by causing a reaction between an alcohol and a carboxylic acid (or a carboxylic acid halide) in the presence of an acid catalyst. A raw material of the synthetic ester wax may be a commercially available synthetic product or a substance derived from a natural product such as a long-chain fatty acid prepared from a natural oil. Preferable examples of the natural ester wax include a carnauba wax and a rice wax.

In order to ensure that the releasing agent has a sufficient amount of the carboxyl group, the releasing agent having the carboxyl group has an acid value of preferably at least 1.0 mgKOH/g, and more preferably at least 1.0 mgKOH/g and no greater than 10.0 mgKOH/g. Also, the releasing agent having the carboxyl group has a melting point of preferably at least 65° C. and no higher than 75° C., and more preferably at least 70° C. and no higher than 75° C. The melting point of the releasing agent can be measured by the following method. First, 15 mg of a measurement target (more specifically, the releasing agent) is placed on an aluminum pan and the aluminum pan is then set in a measurement section of a differential scanning calorimeter ("DSC-6220" manufactured by Seiko Instruments Inc.). Also, an empty aluminum pan is used as a reference. The temperature of the measurement section is increased from a measurement start temperature of 30° C. to 170° C. at a rate of 10° C./minute to plot a heat absorption curve. The heat absorption curve [vertical axis: heat flow (DSC signal), horizontal axis: temperature] of the measurement target is plotted while the temperature is increased. The melting point of the measurement target is read from the plotted heat absorption curve. A temperature at a maximum peak of the heat absorption curve due to heat of fusion corresponds to the melting point of the measurement target.

(Charge Control Agent)

The toner cores may contain a charge control agent. The charge control agent is used in order to obtain a toner excellent in charge stability and a charge rise characteristic, for example. The charge rise characteristic of the toner is an indicator as to whether or not the toner can be charged to a specific charge level in a short period of time.

Anionic strength of the toner cores can be increased through inclusion of a negatively chargeable charge control agent (specific examples include organic metal complexes and chelate compounds) in the toner cores. Cationic strength of the toner cores can be increased through inclusion of a positively chargeable charge control agent (specific examples include pyridine, nigrosine, and quaternary ammonium salts) in the toner cores. However, inclusion of a charge control agent in the toner cores is inessential so long as the toner has sufficient chargeability.

(Magnetic Powder)

The toner cores may contain a magnetic powder. Examples of materials of the magnetic powder include ferromagnetic metals (specific examples include iron, cobalt, nickel, and alloys thereof), ferromagnetic metal oxides (specific examples include ferrite, magnetite, and chromium dioxide), and materials subjected to ferromagnetization (specific examples include carbon materials rendered ferromagnetic through thermal treatment). One magnetic powder may be used independently, or two or more magnetic powders may be used in combination.

In order to inhibit elution of metal ions (for example, iron ions) from the magnetic powder, the magnetic powder is preferably subjected to surface treatment. When metal ions are eluted to the surfaces of the toner cores in formation of the shell layers on the surfaces of the toner cores in an acidic condition, the toner cores tend to adhere to one another. It is thought that adhesion of the toner cores to one another can be inhibited through inhibition of elution of the metal ions from the magnetic powder.

[Shell Layers]

The shell layers are substantially constituted by a resin. The shell layers preferably contain a resin, and more preferably contain a resin only. The shell layers of the toner according to the present embodiment include a unit having a non-ring-opened oxazoline group. A preferable example of the unit having a non-ring-opened oxazoline group is the unit (A) described above. The unit (A) can be introduced into the shell layers through polymerization of a compound represented by formula (1) shown below. In the following description, the compound represented by formula (1) may be referred to as a "compound (1)". In formula (1), $R^1$ represents the same chemical group as that represented by $R^1$ in formula (A). Preferable examples of chemical groups represented by $R^1$ in formula (1) are the same as the preferable examples of chemical groups represented by $R^1$ in formula (A).

(1)

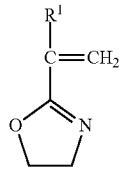

The unit (A) is a repeating unit from which a main chain of the shell layers is formed. Through polymerization (addition polymerization) of the compound (1), which is a vinyl compound, "C═C" changes to "—C—C—", resulting in formation of a polymer (for example, a vinyl resin). A vinyl compound is a compound having a vinyl group ($CH_2$═CH—) or a compound having a chemical group formed through substitution of a hydrogen atom in a vinyl group. A polymer (for example, a vinyl resin) may be formed through polymerization of the compound (1) and a vinyl compound other than the compound (1). Examples of vinyl compounds other than the compound (1) include ethylene, propylene, butadiene, vinyl chloride, (meth)acrylic acid, (meth)acrylic acid ester (preferably, (meth)acrylic acid alkyl ester), acrylonitrile, and styrene.

The shell layers preferably contain a polymer of monomers including the compound (1) and a (meth)acrylic acid alkyl ester. The shell layers more preferably contain only the polymer of monomers including the compound (1) and a (meth)acrylic acid alkyl ester. The polymer of monomers including the compound (1) and a (meth)acrylic acid alkyl ester is a preferable example of vinyl resins. The monomers are resin raw materials for shell layer formation. The monomers as the resin raw materials for shell layer formation may include only the compound (1) and a (meth)acrylic acid alkyl ester. Alternatively, the monomers as the resin raw materials for shell layer formation may further include a compound other than the compound (1) and a (meth)acrylic acid alkyl ester in addition to the compound (1) and the (meth)acrylic acid alkyl ester.

Preferable examples of the compound (1) include 2-vinyl-2-oxazoline. The (meth)acrylic acid alkyl ester is preferably methyl (meth)acrylate or ethyl (meth)acrylate, and more preferably methyl methacrylate. The (meth)acrylic acid alkyl ester is a preferable example of vinyl compounds other than the compound (1). Addition of the (meth)acrylic acid alkyl ester tends to result in improvement in coverage of the shell layers.

In order that the toner can be suitable for use in image formation, the shell layers preferably have a thickness of at least 10 nm and no greater than 100 nm. The thickness of the shell layers can be measured through analysis of a transmission electron microscope (TEM) image of cross sections of toner particles using commercially available image analysis software (for example, "WinROOF" manufactured by Mitani Corporation). Note that in a situation in which the shell layer of a toner particle does not have a uniform thickness, thicknesses of the shell layer are measured at four locations equally spaced from each other (specifically, four locations of intersection between the shell layer and two straight lines orthogonally crossing each other substantially at the center of a cross section of the toner particle), and an arithmetic mean of the thus measured four values is calculated as an evaluation value (thickness of the shell layer) of the toner particle. Boundaries between the toner cores and the shell layers can be confirmed for example by selectively dying only the shell layers without dying the toner cores. When the boundaries between the toner cores and the shell layers in the TEM image are unclear, the boundaries can be clarified by mapping characteristic elements contained in the shell layers through a combination of transmission electron microscopy (TEM) and electron energy-loss spectroscopy (EELS).

[Organic Particles]

The toner according to the present embodiment includes the organic particles located between the shell layers and the toner cores (i.e., at interfaces therebetween). Owing to the organic particles located between the shell layers and the toner cores (i.e., at the interfaces therebetween), the following advantages can be obtained. First, the organic particles located between the shell layers and the toner cores impart elasticity to the toner. As a result, occurrence of hot offset can be inhibited, resulting in an increase in the fixable temperature range of the toner. Also, occurrence of document offset can be inhibited. Second, the organic particles located between the shell layers and the toner cores can function as spacers. As a result of the organic particles functioning as spacers, detachment of an external additive from the toner particles can be inhibited. As a consequence, attachment of a detached external additive to a carrier (i.e., carrier contamination) can be inhibited. Third, detachment of the organic particles from the toner cores can be inhibited since the organic particles are covered with the shell layers.

The organic particles contain a resin. In the following description, the resin contained in the organic particles may be referred to as a "resin for organic particle use". The organic particles preferably contain only the resin for organic particle use. The resin for organic particle use has a carboxyl group. The resin for organic particle use having a carboxyl group is preferably a polyester resin.

The polyester resin can be obtained by condensation polymerization or co-condensation polymerization of an alcohol monomer and a carboxylic acid monomer. The polyester resin is a polymer of the alcohol monomer and the carboxylic acid monomer.

Examples of alcohol monomers include diol monomers, bisphenol monomers, and tri- or higher-hydric alcohol monomers.

Examples of diol monomers include ethylene glycol, diethylene glycol, triethylene glycol, 1,2-propanediol, 1,3-propanediol, 1,4-butanediol, neopentyl glycol, 2-butene-1,4-diol, 1,5-pentanediol, 1,6-hexanediol, 1,4-cyclohexanedimethanol, dipropylene glycol, polyethylene glycol, polypropylene glycol, and polytetramethylene glycol.

Examples of bisphenol monomers include bisphenol A, hydrogenated bisphenol A, bisphenol A ethylene oxide adduct, and bisphenol A propylene oxide adduct (for example, bisphenol A-propylene oxide 2 mole adduct).

Examples of tri- or higher-hydric alcohol monomers include sorbitol, 1,2,3,6-hexanetetraol, 1,4-sorbitan, pentaerythritol, dipentaerythritol, tripentaerythritol, 1,2,4-butanetriol, 1,2,5-pentanetriol, glycerol, diglycerol, 2-methylpropanetriol, 2-methyl-1,2,4-butanetriol, trimethylolethane, trimethylolpropane, and 1,3,5-trihydroxymethylbenzene.

Examples of carboxylic acid monomers include dibasic carboxylic acid monomers and tri- or higher-basic carboxylic acid monomers.

Examples of dibasic carboxylic acid monomers include maleic acid, fumaric acid, citraconic acid, itaconic acid, glutaconic acid, phthalic acid, isophthalic acid, terephthalic acid, 5-sulfoisophthalic acid, sodium 5-sulfoisophthalate, cyclohexanedicarboxylic acid, adipic acid, sebacic acid, azelaic acid, malonic acid, succinic acid, alkyl succinic acids, and alkenyl succinic acids. Examples of alkyl succinic acids include n-butylsuccinic acid, isobutylsuccinic acid, n-octylsuccinic acid, n-dodecylsuccinic acid, and isododecylsuccinic acid. Examples of alkenyl succinic acids include n-butenylsuccinic acid, isobutenylsuccinic acid, n-octenylsuccinic acid, n-dodecenylsuccinic acid, and isododecenylsuccinic acid.

Examples of tri- or higher-basic carboxylic acid monomers include 1,2,4-benzenetricarboxylic acid (trimellitic acid), 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, 1,2,4-cyclohexanetricarboxylic acid, tetra(methylenecarboxyl)methane, 1,2,7,8-octanetetracarboxylic acid, pyromellitic acid, and EMPOL trimer acid.

One alcohol monomer may be used independently, or two or more alcohol monomers may be used in combination. One carboxylic acid monomer may be used independently, or two or more carboxylic acid monomers may be used in combination. Further, a carboxylic acid monomer may be derivatized to be used as an ester-forming derivative. Examples of ester-forming derivatives include acid halides, acid anhydrides, and lower alkyl esters. Examples of lower alkyls include an alkyl group having a carbon number of at least 1 and no greater than 6.

In a case where the resin for organic particle use is a polyester resin, the polyester resin is preferably a polymer of monomers including a diol monomer, a bisphenol monomer, and a dibasic carboxylic acid monomer. The polyester resin is more preferably a polymer of monomers including only a diol monomer, a bisphenol monomer, and a dibasic carboxylic acid monomer. Alternatively, the polyester resin is preferably a polymer of monomers including ethylene glycol, a bisphenol A propylene oxide adduct, isophthalic acid, terephthalic acid, and sodium 5-sulfoisophthalate. The polyester resin is more preferably a polymer of monomers including only ethylene glycol, a bisphenol A propylene oxide adduct, isophthalic acid, terephthalic acid, and sodium 5-sulfoisophthalate.

The resin for organic particle use has a mass average molecular weight of at least 30,000 and no greater than 50,500. As a result of the resin for organic particle use having a mass average molecular weight within the above range, occurrence of hot offset can be inhibited and low-temperature fixability of the toner can be improved while elasticity is imparted to the toner. When the mass average molecular weight of the resin for organic particle use is smaller than 30,000, hot offset occurs. When the mass average molecular weight of the resin for organic particle use is greater than 50,500, low-temperature fixability of the toner degrades.

More preferably, the resin for organic particle use has a mass average molecular weight of at least 35,000 and no greater than 50,000. It is also preferable that the mass average molecular weight of the resin for organic particle use falls within a range between two values selected from 30,000, 35,000, 41,000, 50,000, and 50,500.

The mass average molecular weight of the resin for organic particle use can be measured by gel permeation chromatography (GPC). A method for measuring the mass average molecular weight of the resin for organic particle use will be described later in detail in Examples. The mass average molecular weight of the resin for organic particle use can be adjusted for example by changing a reaction time in synthesis of the resin for organic particle use. The longer the reaction time in synthesis of the resin for organic particle use is, the larger the mass average molecular weight of the resin for organic particle use becomes.

The organic particles have a volume median diameter ($D_{50}$) of preferably at least 100 nm and no greater than 200 nm, and more preferably at least 130 nm and no greater than 170 nm.

In order to ensure that the resin for organic particle use has a sufficient amount of the carboxyl group, the resin for organic particle use preferably has an acid value of at least 1.0 mgKOH/g and no greater than 20.0 mgKOH/g, and more preferably at least 12.0 mgKOH/g and no greater than 17.0 mgKOH/g.

[External Additive]

An external additive (specifically, a powder, which is a mass of external additive particles) may be attached to the surfaces of the toner mother particles. Unlike internal additives, the external additive is not present inside the toner mother particles, and is selectively present on the surfaces of the toner mother particles (i.e., in surface portions of the toner particles). The external additive particles can be attached to the surfaces of the toner mother particles by stirring the toner mother particles (powder) and the external additive (powder) together, for example. The toner mother particles and the external additive particles do not chemically react with each other, and are bonded to each other physically rather than chemically. Bonding strength between the toner mother particles and the external additive particles can be adjusted for example by controlling conditions for stirring (specifically, a stirring time, a rotational speed for stirring, and the like), particle diameter of the external additive particles, shape of the external additive particles, and surface conditions of the external additive particles.

In order to make the external additive to sufficiently exhibit its function while inhibiting detachment of the external additive particles from the toner particles, an amount of the external additive (in a case where two or more types of external additive particles are used, a sum of amounts of the respective types of external additive particles) relative to 100 parts by mass of the toner mother particles is preferably at least 0.5 parts by mass and no greater than 10 parts by mass.

Inorganic particles are preferable as the external additive particles, and silica particles or particles of metal oxides (specific examples include alumina, titanium oxide, magnesium oxide, zinc oxide, strontium titanate, and barium titanate) are particularly preferable as the external additive particles. Particles of organic acid compounds such as fatty acid metal salts (specific examples include zinc stearate) or resin particles can also be used as the external additive particles. One type of external additive particles may be used independently, or two or more types of external additive particles may be used in combination.

Note that the toner according to the present embodiment can be used as a positively chargeable toner for development of electrostatic latent images, for example. The toner according to the present embodiment is a powder including the toner particles. The toner may be used as a one-component developer. Alternatively, the toner may be mixed with a carrier using a mixer (for example, a ball mill) to prepare a two-component developer. In order to form high quality images with the toner, an amount of the toner in the two-component developer relative to 100 parts by mass of the carrier is preferably at least 5 parts by mass and no greater than 15 parts by mass. Preferably, the carrier has a number average primary particle diameter of at least 20 μm and no greater than 120 μm. Note that a positively chargeable toner included in a two-component developer is positively charged through friction with a carrier.

The following describes a method for producing the toner. The method for producing the toner includes: a toner core formation process; an organic particle attachment process; and a shell layer formation process.

The following describes the toner core formation process. Preferable examples of methods for producing the toner cores include the aggregation method. In an example of the aggregation method, the releasing agent and a colorant each in the form of fine particles are initially caused to aggregate in an aqueous medium until aggregated particles having a desired particle diameter are formed. Through the above, the aggregated particles containing the releasing agent and the colorant are formed. Subsequently, the obtained aggregated particles are heated to cause coalescence of the components contained in the aggregated particles. Through the above, toner cores having a desired particle diameter are obtained.

The following describes the organic particle attachment process. In the organic particle attachment process, the toner cores and the organic particles are mixed. Through the above, the organic particles are attached to surfaces of the toner cores to form composite cores.

The following describes the shell layer formation process. Examples of methods for forming the shell layers include in-situ polymerization, in-liquid curing film coating, and coacervation. More specifically, the composite cores are added to an aqueous medium in which a water-soluble shell material has been dissolved. Subsequently, the aqueous medium is heated to cause polymerization of the shell material to proceed. Through the above, the shell layers are formed on surfaces of the composite cores.

In formation of the shell layers, resin particles (for example, a resin dispersion) may be used as the shell material. More specifically, the resin particles are attached to the surfaces of the composite cores in a liquid (for example, an aqueous medium) containing the resin particles and the composite cores. Subsequently, the liquid is heated to cause formation of films from the resin particles to proceed, whereby the shell layers are formed on the surfaces of the composite cores. Bonding of the resin particles to one another (eventually, a crosslinking reaction in the resin particles) can be caused to proceed on the surfaces of the toner cores while the liquid is maintained at a high temperature.

The aqueous medium is a medium including water as a main component (specific examples include pure water and a liquid mixture of water and a polar medium). Examples of the polar medium included in the aqueous medium include alcohols (specific examples include methanol and ethanol). The aqueous medium has a boiling point of approximately 100° C.

The shell layers may be formed on the surfaces of the toner cores in a liquid containing a basic substance (specific examples include ammonia and sodium hydroxide) and/or a ring-opening agent (specific examples include acetic acid). In a situation in which a shell material having an oxazoline group is used, an amount of non-ring-opened oxazoline groups included in the shell layers can be adjusted by changing respective amounts of the basic substance and the ring-opening agent. The amount of the non-ring-opened oxazoline groups tends to increase with an increase in the amount of the basic substance contained in the liquid. Ring-opening of the oxazoline group (a nucleophilic addition reaction with a carbonyl group) is thought to be inhibited by neutralization (trapping) of a carboxylic acid by the basic substance. By contrast, the ring-opening agent promotes ring-opening of the oxazoline group. Accordingly, the amount of the non-ring-opened oxazoline groups tends to decrease with an increase in the amount of the ring-opening agent contained in the liquid.

Figure 4:
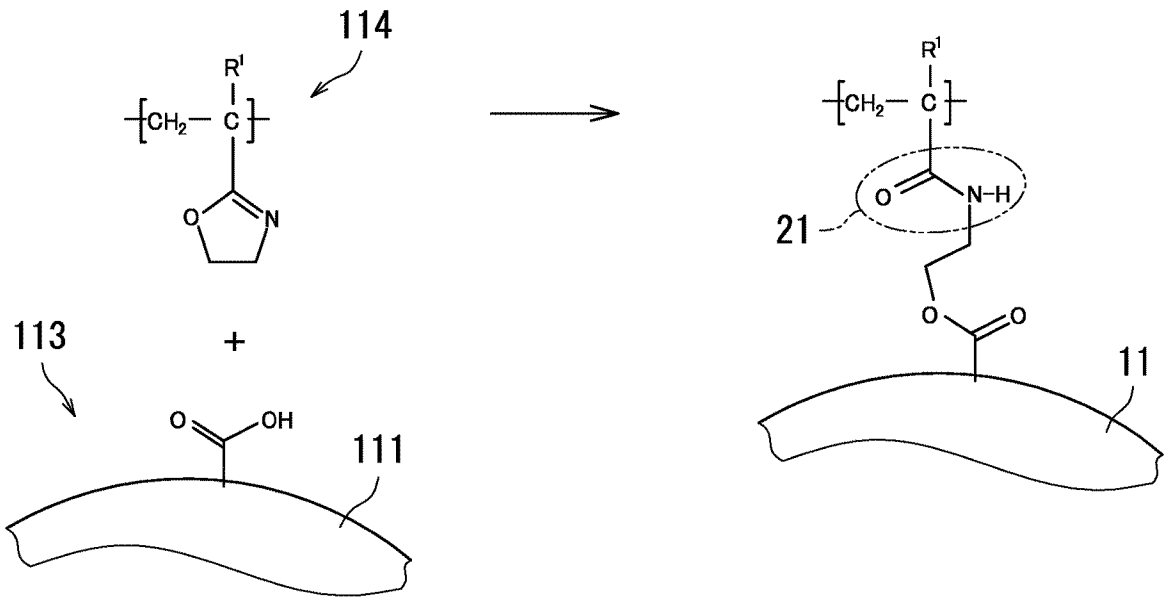
FIG. 4 is a diagram schematically illustrating a reaction between a releasing agent contained in toner cores and shell layers.
Figure 5:
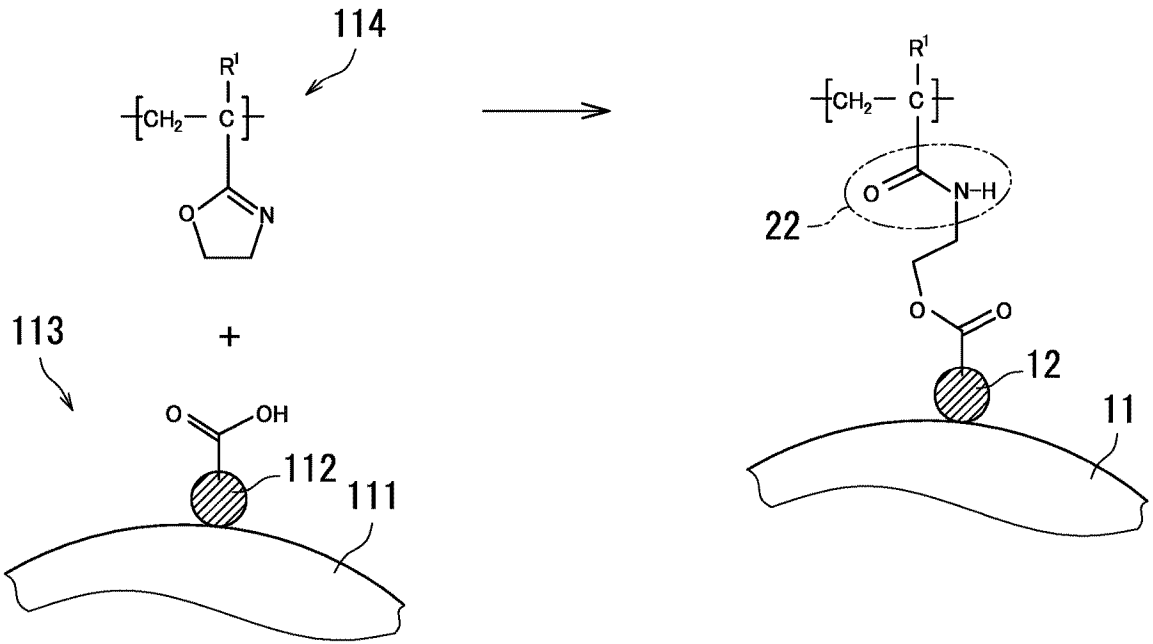
FIG. 5 is a diagram schematically illustrating a reaction between organic particles and the shell layers.

The following specifically describes the shell layer formation process with reference to FIGS. 4 and 5. FIG. 4 schematically illustrates a reaction between the releasing agent contained in the toner cores and the shell layers in the shell layer formation process. FIG. 5 schematically illustrates a reaction between the organic particles and the shell layers in the shell layer formation process.

First, composite cores 113 and a shell layer formation liquid are mixed to obtain a dispersion. The composite cores 113 each include a toner core 111 having a carboxyl group at a surface thereof, as illustrated in FIG. 4. The composite cores 113 each include organic particles 112 each having a carboxyl group at a surface thereof, as illustrated in FIG. 5. The shell layer formation liquid contains a vinyl resin 114 for formation. The vinyl resin 114 for formation includes the unit (A). Next, the temperature of the dispersion is increased to a specific temperature (for example, 60° C.) at a specific heating rate (for example, 0.5° C./minute) while the dispersion is stirred. Thereafter, the temperature of the dispersion is kept at the specific temperature while the dispersion is stirred. A reaction between the carboxyl group of the toner core 111 and an oxazoline group proceeds while the temperature of the dispersion is kept at the specific temperature. More specifically, a reaction between the carboxyl group of the releasing agent contained in the toner core 111 and the oxazoline group proceeds to form an amide bond 21. Through the above, the toner core 11 and the shell layer 14 (see FIG. 1) are bonded through the amide bond 21. More specifically, the shell layer 14 is formed that is bonded to the releasing agent contained in the toner core 11 through the amide bond 21. Also, while the temperature of the dispersion is kept at the specific temperature as described above, a reaction between the carboxyl group of the organic particle 112 and an oxazoline group proceeds. More specifically, a reaction between the carboxyl group of the organic particle 112 and the oxazoline group proceeds to form an amide bond 22. Through the above, the shell layer 14 is formed that is bonded to the toner core 11 through the amide bond 21 and that is bonded to the organic particle 12 through the amide bond 22. Through the above, the shell layer formation process has been described with reference to FIGS. 4 and 5.

EXAMPLES

The following more specifically describes the present disclosure using examples. Note that the present disclosure is by no means limited to the scope of the examples. Tables 1 and 2 show toners T-A1 to T-A9 according to Examples and toners T-B1 to T-B9 according to Comparative Examples. In Tables 1 and 2, proportions of respective amounts of a releasing agent relative to a mass of toner cores are shown in the column titled "Releasing agent proportion". In Tables 1 and 2, "wt %" represents % by mass and "Mw" represents mass average molecular weight. Further, temperatures of respective toners when the storage elastic modulus of the toners was $10^8$ Pa are shown in the column titled "$10^8$ Pa toner temperature". Also, temperatures of the respective toners when the storage elastic modulus of the toners was $10^5$ Pa are shown in the column titled "$10^5$ Pa toner temperature".

TABLE 1

| | Toner | Composite core: Toner core: Releasing agent | Composite core: Toner core: Releasing agent proportion | Composite core: Toner core: Colorant | Composite core: Toner core: Binder resin | Composite core: Toner core: Organic particle | | Shell layer: Shell material | Shell layer: Acetic acid | Non-ring-opened oxazoline group content | ΔH | $10^8$ Pa toner temperature | $10^5$ Pa toner temperature | $G'_{130}$ | Tg |
|---|---|---|---|---|---|---|---|---|---|---|---|---|---|---|---|
| | No. | [g] | [wt %] | [g] | [g] | Type | Mw | [g] | [g] | [μmol/g] | [mJ/mg] | [° C.] | [° C.] | [Pa] | [° C.] |
| Example 1 | T-A1 | 350 | 91 | 35 | 0 | P-1 | 41,000 | 8 | 0 | 565 | 82 | 72 | 82 | 22,000 | 66 |
| Example 2 | T-A2 | 550 | 94 | 35 | 0 | P-1 | 41,000 | 7 | 0 | 505 | 160 | 70 | 82 | 23,000 | 66 |
| Example 3 | T-A3 | 350 | 91 | 35 | 0 | P-1 | 41,000 | 8 | 2 | 508 | 80 | 72 | 82 | 20,000 | 66 |
| Example 4 | T-A4 | 350 | 91 | 35 | 0 | P-1 | 41,000 | 11 | 0 | 1,400 | 83 | 76 | 84 | 35,000 | 67 |
| Example 5 | T-A5 | 550 | 94 | 35 | 0 | P-1 | 41,000 | 11 | 0 | 1,400 | 157 | 75 | 83 | 37,000 | 67 |
| Example 6 | T-A6 | 350 | 91 | 35 | 0 | P-2 | 30,000 | 8 | 0 | 565 | 82 | 72 | 82 | 10,000 | 66 |
| Example 7 | T-A7 | 350 | 91 | 35 | 0 | P-3 | 50,500 | 8 | 0 | 565 | 82 | 72 | 82 | 45,000 | 68 |
| Example 8 | T-A8 | 550 | 94 | 35 | 0 | P-2 | 30,000 | 11 | 0 | 1,320 | 157 | 75 | 84 | 13,000 | 66 |
| Example 9 | T-A9 | 550 | 94 | 35 | 0 | P-3 | 50,500 | 11 | 0 | 1,320 | 158 | 74 | 85 | 50,000 | 70 |

TABLE 2

| | Toner | Composite core: Toner core: Releasing agent | Composite core: Toner core: Releasing agent proportion | Composite core: Toner core: Colorant | Composite core: Toner core: Binder resin | Composite core: Toner core: Organic particle | | Shell layer: Shell material | Shell layer: Acetic acid |
|---|---|---|---|---|---|---|---|---|---|
| | No. | [g] | [wt %] | [g] | [g] | Type | Mw | [g] | [g] |
| Comparative Example 1 | T-B1 | 350 | 91 | 35 | 0 | P-1 | 41,000 | 7 | 0 |
| Comparative Example 2 | T-B2 | 300 | 90 | 35 | 0 | P-1 | 41,000 | 8 | 0 |
| Comparative Example 3 | T-B3 | 550 | 94 | 35 | 0 | P-1 | 41,000 | 12 | 0 |
| Comparative Example 4 | T-B4 | 600 | 94 | 35 | 0 | P-1 | 41,000 | 11 | 0 |
| Comparative Example 5 | T-B5 | 350 | 91 | 35 | 0 | P-4 | 28,000 | 8 | 0 |
| Comparative Example 6 | T-B6 | 350 | 91 | 35 | 0 | P-5 | 53,000 | 8 | 0 |
| Comparative Example 7 | T-B7 | 550 | 94 | 35 | 0 | P-4 | 28,000 | 11 | 0 |
| Comparative Example 8 | T-B8 | 550 | 94 | 35 | 0 | P-5 | 53,000 | 11 | 0 |
| Comparative Example 9 | T-B9 | 350 | 91 | 35 | 0 | None | None | 8 | 0 |

| | Non-ring-opened oxazoline group content [μmol/g] | ΔH [mJ/mg] | $10^8$ Pa toner temperature [° C.] | $10^5$ Pa toner temperature [° C.] | $G'_{130}$ [Pa] | Tg [° C.] |
|---|---|---|---|---|---|---|
| Comparative Example 1 | 480 | 82 | 72 | 82 | 20,000 | 66 |
| Comparative Example 2 | 520 | 75 | 71 | 82 | 20,000 | 66 |
| Comparative Example 3 | 1,550 | 157 | 77 | 86 | 37,000 | 67 |
| Comparative Example 4 | 1,390 | 169 | 75 | 83 | 35,000 | 67 |
| Comparative Example 5 | 560 | 81 | 73 | 82 | 9,000 | 65 |
| Comparative Example 6 | 565 | 82 | 72 | 83 | 48,000 | 69 |
| Comparative Example 7 | 1,320 | 157 | 75 | 84 | 13,000 | 66 |
| Comparative Example 8 | 1,320 | 158 | 74 | 87 | 50,600 | 70 |
| Comparative Example 9 | 563 | 81 | 72 | 82 | 3,000 | 65 |

The following describes production methods, measurement methods, evaluation methods, and evaluation results for the toners T-A1 to T-A9 and T-B1 to T-B9. Note that in evaluation in which errors might occur, an appropriate number of measurement values were obtained and an arithmetic mean of the measurement values was determined as an evaluation value so that any errors were sufficiently small.

[Toner Production Method]

(Preparation of Wax Dispersion)

With respect to each of the toners (T-A1 to T-A9 and T-B1 to T-B9, demineralized water, a high-purity solid ester wax ("NISSAN ELECTOL (registered Japanese trademark) WEP-9" manufactured by NOF Corporation, acid value: 1.5 mgKOH/g, melting point: 72°) in an amount shown in Table 1 or 2, and 20 g of an anionic surfactant ("NEOGEN (registered Japanese trademark) SC" manufactured by DKS Co. Ltd., ingredient: sodium dodecylbenzenesulfonate, active component: 66% by mass) were mixed. The resultant mixture was emulsified through high-pressure shearing using a Gaulin homogenizer ("APV (registered Japanese trademark)" manufactured by SPX Corporation). As a result, 1,000 g of a wax dispersion was obtained. An amount of demineralized water was determined such that a sum of the amount of demineralized water, the amount of the releasing agent (NISSAN ELECTOL WEP-9), and the amount of the anionic surfactant (NEOGEN SC) became 1,000 g. For example, in production of the toner T-A1, a mixture of 630 g of demineralized water, 350 g of the releasing agent (NISSAN ELECTOL WEP-9, see Table 1), and 20 g of the anionic surfactant (NEOGEN SC) was emulsified through high-pressure shearing. In production of the toner T-A2, a mixture of 430 g of demineralized water, 550 g of the releasing agent (NISSAN ELECTOL WEP-9, see Table 1), and 20 g of the anionic surfactant (NEOGEN SC) was emulsified through high-pressure shearing.

(Formation of Toner Cores)

A 2-L reaction vessel equipped with an anchor type stirring impeller with a baffle plate was charged with 1,000 g of the wax dispersion prepared as above and 100 g of a colorant dispersion. The colorant dispersion was an aqueous dispersion of a colorant ("EP-700 Blue GA" manufactured by Dainichiseika Color & Chemicals Mfg. Co., Ltd., ingredient: copper phthalocyanine pigment (β), color index: Pigment Blue 15:3, solid concentration: 35% by mass). Note that the colorant dispersion had a solid concentration of 35% by mass. Therefore, a mass of the colorant used in production of each of the toners T-A1 to T-A9 and T-B1 to T-B9 was 35 g (=100×0.35).

Subsequently, a coagulant (aqueous aluminum sulfate solution, aluminum sulfate solid content: 4 g) was dripped into the vessel at a rate of 0.2 g/minute while the vessel contents were stirred. After completion of dripping of the coagulant, the temperature of the vessel contents was increased from 30° C. to 50° C. at a rate of 1° C./minute while the vessel contents were stirred. Once the temperature of the vessel contents reached 50° C., the temperature of the vessel contents was kept at 50° C. to promote aggregation of particles within the vessel for granulation. Specifically, the temperature of the vessel contents was kept at 50° C. for about 1 hour until a volume median diameter ($D_{50}$) of the resultant aggregated particles became 7 μm.

Once the volume median diameter of the resultant aggregated particles within the vessel became 7 μm, an aqueous sodium dodecylbenzenesulfonate solution (aqueous solution of "NEOGEN SC" manufactured by DKS Co. Ltd., solid concentration: 10% by mass, sodium dodecylbenzenesulfonate solid content: 2 g) was added into the vessel. The temperature of the vessel contents was increased from 50° C. to 90° C. at a constant rate over 40 minutes. After the heating, the temperature of the vessel contents was kept at 90° C. for 2 hours. Thereafter, the vessel contents were cooled to 40° C. at a constant rate over 10 minutes. Subsequently, the vessel contents were subjected to suction filtration using a Buchner funnel in which filter paper having a pore size of 5 μm had been set. Subsequently, a solid (powder) collected by the filtration (i.e., solid-liquid separation) of the vessel contents was washed with 5 L of ion exchanged water. Thereafter, reslurrying was performed by adding 1.6 L of ion exchanged water to obtain a toner core dispersion having a solid concentration of 20% by mass. The obtained toner core dispersion was dried to collect toner cores.

The toner cores had a composition corresponding to amounts of the respective materials used. In Tables 1 and 2, proportions of respective amounts of the releasing agent relative to a mass of the toner cores are shown in the column titled "Releasing agent proportion". A proportion of an amount of the releasing agent relative to the mass of the toner cores (i.e., a releasing agent proportion) was calculated by the following expression: releasing agent proportion (unit: % by mass)=100×amount of releasing agent (unit: g)/[amount of releasing agent (unit: g)+amount of colorant (unit: g)]. For example, in the toner T-A1, the proportion of the amount of the releasing agent relative to the mass of the toner cores was 91% by mass (=100×350/(350+35)).

(Attachment of Organic Particles)

First, 200 g of the toner cores obtained through formation of the toner cores and 1 g of organic particles of a type shown in the column titled "Type" under "Organic particle" in Table 1 or 2 were mixed using an FM mixer (product of Nippon Coke & Engineering Co., Ltd.). Through the above, the organic particles were attached to surfaces of the toner cores to obtain composite cores. Note that respective types of organic particles P-1 to P-5 shown in Tables 1 and 2 were synthesized by the following methods.

(Synthesis of Organic Particles P-1)

First, a polyester resin to be used for the organic particles P-1 was prepared. Specifically, a reaction vessel equipped with a stirrer, a condenser, a thermometer, and a nitrogen inlet tube was charged with monomers. The monomers used were a bisphenol A-propylene oxide 2 mole adduct (43.0 parts by mass), ethylene glycol (9.0 parts by mass), terephthalic acid (25.0 parts by mass), isophthalic acid (15.0 parts by mass), and sodium 5-sulfoisophthalate (8.0 parts by mass). Tetrabutoxy titanate (0.03 parts by mass), which is an esterification catalyst, was added into the reaction vessel. The temperature of the vessel contents was increased to 220° C. in a nitrogen atmosphere. The vessel contents were stirred for 5 hours in the nitrogen atmosphere while the temperature of the vessel contents was kept at 220° C. (hereinafter referred to as first stirring). Then, the inside of the reaction vessel was depressurized to 15 mmHg and the vessel contents were further stirred for 5 hours (hereinafter referred to as second stirring). As a result, the polyester resin for the organic particles P-1 was obtained. Note that the first stirring and the second stirring were performed for 10 hours in total.

Next, the polyester resin for the organic particles P-1 (100.0 parts by mass), methyl ethyl ketone (90.0 parts by mass), and triethylamine (2.0 parts by mass) were placed in another reaction vessel equipped with a stirrer, a condenser, a thermometer, and a nitrogen inlet tube. The vessel contents were heated to 80° C. to dissolve, whereby a solution was obtained. Next, ion exchanged water (300.0 parts by mass) at a temperature of 80° C. was added to the solution while the solution was stirred. Through the above, the solution was dispersed in water and an aqueous dispersion was obtained. The aqueous dispersion was loaded into a distillation device, and distillation was performed until the temperature of a fraction reached 100° C. The aqueous dispersion subjected to distillation was cooled, and then ion exchanged water was added to the aqueous dispersion to adjust the concentration of the polyester resin for the organic particles P-1 in the aqueous dispersion to 20% by mass. Then, the polyester resin for the organic particles P-1 was collected from the aqueous dispersion and dried in a vacuum at 40° C. for 24 hours. Through the above, the organic particles P-1 were obtained. The polyester resin contained in the organic particles P-1 had a mass average molecular weight of 41,000 and an acid value of 15.0 mgKOH/g.

(Synthesis of Organic Particles P-2)

The organic particles P-2 were obtained by the same method as that for synthesis of the organic particles P-1 in all aspects other than that the first stirring and the second stirring were performed for 8 hours in total rather than 10 hours. A polyester resin contained in the organic particles P-2 had a mass average molecular weight of 30,000 and an acid value of 17.0 mgKOH/g.

(Synthesis of Organic Particles P-3)

The organic particles P-3 were obtained by the same method as that for synthesis of the organic particles P-1 in all aspects other than that the first stirring and the second stirring were performed for 11 hours in total rather than 10 hours. A polyester resin contained in the organic particles P-3 had a mass average molecular weight of 50,500 and an acid value of 12.0 mgKOH/g.

(Synthesis of Organic Particles P-4)

The organic particles P-4 were obtained by the same method as that for synthesis of the organic particles P-1 in all aspects other than that the first stirring and the second stirring were performed for 7.5 hours in total rather than 10 hours. A polyester resin contained in the organic particles P-4 had a mass average molecular weight of 28,000 and an acid value of 17.5 mgKOH/g.

(Synthesis of Organic Particles P-5)

The organic particles P-5 were obtained by the same method as that for synthesis of the organic particles P-1 in all aspects other than that the first stirring and the second stirring were performed for 12 hours in total rather than 10 hours. A polyester resin contained in the organic particles P-5 had a mass average molecular weight of 53,000 and an acid value of 11.0 mgKOH/g.

(Measurement of Mass Average Molecular Weight of Organic Particles)

With respect to each of the polyester resins contained in a corresponding type of the organic particles P-1 to P-5, a mass average molecular weight (Mw) of the polyester resin was measured by gel permeation chromatography (GPC). First, the organic particles (10 mg) formed from the polyester resin were dissolved in tetrahydrofuran (THF, 5 mL) at room temperature over 2 hours to obtain a polyester resin solution. The polyester resin solution was filtered using a membrane filter ("MAISYORIDISUKU" manufactured by Tosoh Corporation, membrane pore diameter: 0.45 μm, solvent resistant) to obtain a sample solution. Measurement of the sample solution was performed using a GPC measurement device ("HLC8120 GPC" manufactured by Tosoh Corporation) under the following GPC measurement conditions. Then, a mass average molecular weight of the polyester resin contained in the sample solution was calculated using a molecular weight calibration curve plotted using standard samples of polystyrene resins ("TSK STANDARD POLYSTYRENE F-850, F-450, F-288, F-128, F-80, F-40, F-20, F-10, F-4, F-2, F-1, A-5000, A-2500, A-1000, and A-500" manufactured by Tosoh Corporation).

(GPC Measurement Conditions)

Detector: RI

Column: 7 serial columns of SHODEX (registered Japanese trademark) KF-801, 802, 803, 804, 805, 806, and 807 (product of Showa Denko K.K.)

Eluent: tetrahydrofuran (THF)

Flow rate: 1.0 mL/minute

Oven temperature: 40.0° C.

Sample solution injection amount: 0.10 mL (Formation of Shell Layers)

A 1-L three-necked flask equipped with a thermometer and a stirring impeller was set in a water bath. Then, 200 g of the composite cores obtained through the attachment of the organic particles and 600 g of purified water were placed in the flask. Thereafter, the internal temperature of the flask was kept at 40° C. using the water bath. Subsequently, a shell material in an amount shown in Table 1 was added into the flask, and the flask contents were stirred at a rotational speed of 200 rpm for 1 hour. The shell material was an aqueous solution of an oxazoline group-containing polymer ("EPOCROS (registered Japanese trademark) WS-300" manufactured by Nippon Shokubai Co., Ltd., monomer composition: methyl methacrylate/2-vinyl-2-oxazoline, solid concentration: 10% by mass). For example, in production of the toner T-A1, 8 g of the shell material (EPOCROS WS-300) was added into the flask. In production of the toner T-A2, 7 g of the shell material (EPOCROS WS-300) was added into the flask.

Subsequently, 8 mL of a 1% by mass aqueous ammonia solution was added into the flask. The internal temperature of the flask was increased to 60° C. at a rate of 0.5° C./minute while the flask contents were stirred at a rotational speed of 150 rpm.

In production of the toner T-A3, once the internal temperature of the flask reached 60° C., acetic acid (concentration: 99% by mass) in an amount shown in Table 1 was added into the flask at a constant rate. Note that acetic acid was not added in production of the toners other than the toner T-A3.

Subsequently, the internal temperature of the flask was kept at 60° C. for 10 minutes while the flask contents were stirred at a rotational speed of 100 rpm. Subsequently, pH of the flask contents was adjusted to 7. A 1% by mass aqueous ammonia solution was used for the pH adjustment. Subsequently, the flask contents were cooled to room temperature (approximately 25° C.), whereby a dispersion of toner mother particles was obtained.

(Washing)

The dispersion of the toner mother particles obtained through the formation of shell layers was filtered (solid-liquid separation) using a Buchner funnel in which filter paper having a pore size of 5 μm had been set to collect a wet cake of the toner mother particles. The wet cake of the toner mother particles was then re-dispersed in ion exchanged water. Further, dispersion and filtration were repeated five times to wash the toner mother particles. The toner mother particles were washed by repeating dispersion and filtration until an electrical conductivity of a filtrate (rinse water) after washing became 1 μS/cm. The electrical conductivity was measured using an electrical conductivity meter "HORIBA ES-51" manufactured by HORIBA, Ltd.

(Drying)

The toner mother particles washed as above were dried using a continuous type surface modifier ("COATMIZER (registered Japanese trademark)" manufactured by Freund Corporation) under conditions of a hot air temperature of 45° C. and a blower flow rate of 2 $m^3$/minute. As a result, a powder of dry toner mother particles was obtained.

(External Additive Addition)

First, 1,000 g of the toner mother particles obtained through the drying, 15 g of positively chargeable silica particles ("AEROSIL (registered Japanese trademark) REA90" manufactured by Nippon Aerosil Co., Ltd., content: dry silica particles rendered positively chargeable through surface treatment, number average primary particle diameter: approximately 20 nm), and 15 g of conductive titanium oxide particles ("EC-100" manufactured by Titan Kogyo, Ltd., base: $TiO_2$ particle, coat layer: Sb-doped $SnO_2$ film) were mixed using an FM mixer (product of Nippon Coke & Engineering Co., Ltd.) for 5 minutes. Through the above, external additives (the positively chargeable silica particles and the conductive titanium oxide particles) were attached to surfaces of the toner mother particles. Thereafter, the toner mother particles with the external additives attached thereto were sifted using a 200-mesh sieve (pore size: 75 μm). As a result, a toner (any of the toners T-A1 to T-A9 and T-B1 to T-B9) having a volume median diameter ($D_{50}$) of 7 μm was obtained.

With respect to each of samples (the toners T-A1 to T-A9 and T-B1 to T-B9), a non-ring-opened oxazoline group content, ΔH of the toner, a glass transition point (Tg) of the toner, a temperature of the toner when the storage elastic modulus of the toner was $10^8$ Pa, a temperature of the toner when the storage elastic modulus of the toner was $10^5$ Pa, and $G'_{130}$ of the toner were measured. Also, a mass average molecular weight (Mw) of the organic particles used in the attachment of the organic particles was measured. Results of the above measurements are shown in Tables 1 and 2. The above measurements were performed by the following methods.

<Measurement Method of Non-Ring-Opened Oxazoline Group Content>

The non-ring-opened oxazoline group content was measured by gas chromatography-mass spectrometry (GC/MS method). In the GC/MS method, a gas chromatograph mass spectrometer ("GCMS-QP2010 ULTRA" manufactured by Shimadzu Corporation) and a multi-shot pyrolyzer ("FRONTIER LAB MULTI-FUNCTIONAL PYROLYZER (registered Japanese trademark) PY-3030D" manufactured by Frontier Laboratories Ltd.) were used as measurement devices. A column used was a GC column ("AGILENT (registered Japanese trademark) J&W ULTRA INERT CAPILLARY GC COLUMN DB-5 ms" manufactured by Agilent Technologies Japan, Ltd., phase: allylene phase with a polymer main chain strengthened through introduction of allylene into a siloxane polymer, inner diameter: 0.25 mm, film thickness: 0.25 μm, length: 30 m).

(Gas Chromatograph Measurement Conditions)

Carrier gas: helium (He) gas

Carrier flow rate: 1 mL/minute

Vaporization chamber temperature: 210° C.

Thermal decomposition temperature: 600° C. at heating furnace and 320° C. at interface section Heating condition: kept at 40° C. for 3 minutes, increased from 40° C. to 300° C. at a rate of 10° C./minute, and kept at 300° C. for 15 minutes (Mass Spectrometry Conditions)

Ionization method: electron impact (EI) method

Ion source temperature: 200° C.

Interface section temperature: 320° C.

Detection mode: scan (measurement range: 45 m/z to 500 m/z)

A peak derived from the non-ring-opened oxazoline group was identified through analysis of a mass spectrum measured under the above conditions. An amount of the non-ring-opened oxazoline group contained in the measurement target (toner) (specifically, an amount of the non-ring-opened oxazoline group contained in 1 g of the toner) was determined from an area of the peak in a measured chromatogram. A calibration curve was used for determination of the amount of the non-ring-opened oxazoline group.

<Measurement Method of Temperatures of Toner when Storage Elastic Modulus of Toner was $10^8$ Pa and $10^5$ Pa and $G'_{130}$ of Toner>

First, 0.1 g of a toner (measurement target: any of the toners T-A1 to T-A9 and T-B1 to T-B9) was set in a pelleting machine and a pressure of 5 MPa was applied to the toner, whereby a cylindrical pellet having a diameter of 10 mm and a thickness of 1.2 mm was obtained. The obtained pellet was set in a measurement device. The measurement device used was a rheometer ("PhysicaMCR-301" manufactured by Anton Paar Japan K.K.). A measurement jig (parallel plate) was attached to an end of a shaft (specifically, a shaft driven by a motor) of the measurement device. The pellet was placed on a plate (specifically, a heater board heated by a heater) of the measurement device. The pellet on the plate was heated to 110° C., thus melting the pellet (a block of the toner) once. When the toner melted wholly, the measurement jig (parallel plate) was brought into close contact with the molten toner to sandwich the toner between two parallel plates (upper plate: measurement jig, lower plate: heater board). The toner was then cooled to 40° C. Thereafter, a storage elastic modulus (G') temperature dependence curve (vertical axis: storage elastic modulus G', horizontal axis: temperature) of the toner was plotted using the measurement device under the following conditions: a measurement temperature range of from 40° C. to 200° C., a heating rate of 4° C./minute, an oscillation frequency of 1 Hz, and a strain of 1% (with the proviso that a strain was 0.01% to 1% within a measurement temperature range of from 40° C. to 100° C.). A temperature of the toner when the storage elastic modulus of the toner was $10^8$ Pa, a temperature of the toner when the storage elastic modulus of the toner was $10^5$ Pa, and $G'_{130}$ of the toner were read from the plotted G' temperature dependence curve.

<Measurement Method of ΔH and Tg>

A differential scanning calorimeter ("DSC-6220" manufactured by Seiko Instruments Inc.) was used as a measurement device. A glass transition point (Tg) of a toner (measurement target: any of the toners T-A1 to T-A9 and T-B1 to T-B9) was determined by plotting a heat absorption curve of the toner using the measurement device. Specifically, 10 mg of the toner was placed on an aluminum pan (aluminum container), and the aluminum pan was set in a measurement section of the measurement device. Also, an empty aluminum pan was used as a reference. In plotting the heat absorption curve, the temperature of the measurement section was increased from a measurement start temperature of −20° C. to 150° C. at a rate of 10° C./minute (RUN 1). Thereafter, the temperature of the measurement section was lowered from 150° C. to −20° C. at a rate of 10° C./minute. Subsequently, the temperature of the measurement section was increased again from −20° C. to 150° C. at a rate of 10° C./minute (RUN 2). The heat absorption curve (vertical axis: heat flow (DSC signal), horizontal axis: temperature) of the sample was plotted in RUN 2. Tg and ΔH of the toner were read from the plotted heat absorption curve. In the heat absorption curve, a temperature (onset temperature) at an inflection point (an intersection point between an extrapolation of a base line and an extrapolation of an inclined portion of the curve) due to glass transition corresponds to the glass transition point (Tg) of the toner. An endothermic quantity (ΔH) due to melting of the releasing agent contained in 1 mg of the toner was determined from an area of an endothermic peak.

[Evaluation Methods]

Each of the samples (the toners T-A1 to T-A9 and T-B1 to T-B9) was evaluated by the following methods.

<Heat-Resistant Preservability>

First, 3 g of a toner (evaluation target: any of the toners T-A1 to T-A9 and T-B1 to T-B9) was placed in a 20-mL polyethylene container, and the container was left to stand in a thermostatic chamber set at 60° C. for 3 hours. Thereafter, the toner was taken out of the thermostatic chamber and cooled at 20° C. for 3 hours to obtain an evaluation toner.

The obtained evaluation toner was placed on a 100-mesh sieve (pore size: 150 μm) of a known mass. A mass of the sieve including the evaluation toner thereon was measured to determine a mass of the toner on the sieve (mass of the toner before sifting). Subsequently, the sieve was set in a powder characteristic evaluation apparatus ("POWDER TESTER (registered Japanese trademark)" manufactured by Hosokawa Micron Corporation) and shaken at a rheostat level of 5 for 30 seconds in accordance with a manual of POWDER TESTER to sift the evaluation toner. After sifting, a mass of the sieve including toner thereon was measured to determine a mass of the toner remaining on the sieve (mass of the toner after sifting). An agglomeration rate (unit: % by mass) was determined from the mass of the toner before sifting and the mass of the toner after sifting based on the following expression. When the agglomeration rate was greater than 10% by mass, heat-resistant preservability of the toner was evaluated as poor.

Agglomeration rate=100×mass of toner after sifting/mass of toner before sifting

<Fixability>

First, 100 parts by mass of a developer carrier (carrier for "TASKalfa5550ci" manufactured by KYOCERA Document Solutions Inc.) and 10 parts by mass of a toner (evaluation target: any of the toners T-A1 to T-A9 and T-B1 to T-B9) were mixed for 30 minutes using a ball mill in an environment at a temperature of 23° C. and a relative humidity of 50% to obtain an evaluation developer (two-component developer).

(Minimum Fixable Temperature and Fixable Temperature Range)

A minimum fixable temperature was evaluated through image formation with the prepared evaluation developer (two-component developer). An evaluation apparatus used was a printer ("FS-C5250DN" manufactured by KYOCERA Document Solutions Inc., modified so that fixing temperature was adjustable) including a roller-roller type heat and pressure fixing device. The evaluation developer was loaded into a development device for cyan color of the evaluation apparatus and a toner for replenishment use (evaluation target: any of the toners T-A1 to T-A9 and T-B1 to T-B9) was loaded into a toner container for the cyan color of the evaluation apparatus.

An unfixed solid image (specifically, an unfixed toner image) was formed on paper (A4 size printing paper) having a basis weight of 90 g/m$^2$ using the evaluation apparatus in an environment at a temperature of 23° C. and a relative humidity of 50% under a condition of a toner application amount of 1.0 mg/cm$^2$. The paper with the image formed thereon was passed through the fixing device of the evaluation apparatus. A lowest temperature (minimum fixable temperature) at which the unfixed solid image was fixable to the paper and a highest temperature (maximum fixable temperature) at which hot offset did not occur were determined by increasing the fixing temperature of the fixing device from 90° C. in increments of 1° C.

In determination of the minimum fixable temperature, whether or not the toner was fixable to the paper was confirmed by the following fold-rubbing test. The evaluation paper passed through the fixing device was folded such that a surface with the image formed thereon faced inwards. Then, 1-kg weight covered with cloth was rubbed on the fold back and forth 5 times. Subsequently, the paper was opened up and a folded part of the paper (part on which the solid image had been formed) was observed. A length of toner peeling (peeling length) in the folded part was measured. A lowest temperature among fixing temperatures for which the peeling length was no longer than 1 mm was determined to be the minimum fixable temperature ($T_1$, unit: ° C.).

In determination of the maximum fixable temperature, whether or not hot offset occurred was confirmed by the following image evaluation. The evaluation paper passed through the fixing device was visually checked. When a stain due to attachment of the toner to a fixing roller was observed on the evaluation paper, it was determined that hot offset occurred. A highest temperature among fixing temperatures for which hot offset did not occur was determined to be the maximum fixable temperature ($T_2$, unit: ° C.).

A fixable temperature range ($T_2-T_1$, unit: ° C.) was calculated from the minimum fixable temperature ($T_1$) and maximum fixable temperature ($T_2$) determined as above. A toner having a minimum fixable temperature ($T_1$) of higher than 105° C. was evaluated as poor in evaluation of the minimum fixable temperature. A toner having a fixable temperature range ($T_2-T_1$) of smaller than 15° C. was evaluated as poor in evaluation of the fixable temperature range.

<Document Offset>

The toner was evaluated in terms of occurrence of document offset through image formation with the evaluation developer (two-component developer). An evaluation apparatus used was a printer ("FS-C5250DN" manufactured by KYOCERA Document Solutions Inc., modified so that fixing temperature was adjustable) including a roller-roller type heat and pressure fixing device. The evaluation developer was loaded into a development device for cyan color of the evaluation apparatus and a toner for replenishment use (evaluation target: any of the toners T-A1 to T-A9 and T-B1 to T-B9) was loaded into a toner container for the cyan color of the evaluation apparatus.

A solid image (image size: 190 mm×270 mm) was successively formed on 100 sheets of paper (A4 size printing paper) having a basis weight of 70 g/m$^2$ using the evaluation apparatus in an environment at a temperature of 32.5° C. and a relative humidity of 80% under conditions of a toner application amount of 0.4 mg/cm$^2$ and a fixing temperature of 120° C. The printed sheets were taken out of the evaluation apparatus after 5 minutes elapsed from completion of printing. Whether or not a surface of any sheet that had been subjected to fixing (surface with the image formed thereon) adhered to another sheet was checked. When the surface of a sheet subjected to fixing adhered to another sheet, it was determined that document offset occurred. When document offset occurred through use of a toner, the toner was evaluated as poor in evaluation of document offset.

[Evaluation Results]

With respect to each of the toners T-A1 to T-A9 and T-B1 to T-B9, evaluation results of heat-resistant preservability (agglomeration rate) and fixability (minimum fixable temperature, fixable temperature range, and occurrence of document offset) are shown in Table 3. In Table 3, "Not occurred" indicates that document offset did not occur, and "Occurred" indicates that document offset occurred.

TABLE 3

| | Toner No. | Heat-resistant preservability Agglomeration rate [wt %] | Fixability: Minimum fixable temperature [° C.] | Fixability: Fixable Temperature range [° C.] | Fixability: Document offset |
|---|---|---|---|---|---|
| Example 1 | T-A1 | 2 | 95 | 20 | Not occurred |
| Example 2 | T-A2 | 2 | 93 | 22 | Not occurred |
| Example 3 | T-A3 | 3 | 97 | 22 | Not occurred |

TABLE 3-continued

| | Toner No. | Heat-resistant preservability Agglomeration rate [wt %] | Fixability: Minimum fixable temperature [° C.] | Fixability: Fixable Temperature range [° C.] | Fixability: Document offset |
|---|---|---|---|---|---|
| Example 4 | T-A4 | 3 | 100 | 24 | Not occurred |
| Example 5 | T-A5 | 3 | 99 | 24 | Not occurred |
| Example 6 | T-A6 | 3 | 92 | 26 | Not occurred |
| Example 7 | T-A7 | 2 | 102 | 28 | Not occurred |
| Example 8 | T-A8 | 2 | 102 | 29 | Not occurred |
| Example 9 | T-A9 | 2 | 104 | 30 | Not occurred |
| Comparative Example 1 | T-B1 | 15 (poor) | 95 | 20 | Not occurred |
| Comparative Example 2 | T-B2 | 2 | 107 (poor) | 15 | Not occurred |
| Comparative Example 3 | T-B3 | 3 | 108 (poor) | 25 | Not occurred |
| Comparative Example 4 | T-B4 | 12 (poor) | 93 | 22 | Not occurred |
| Comparative Example 5 | T-B5 | 3 | 95 | 13 (poor) | Occurred (poor) |
| Comparative Example 6 | T-B6 | 2 | 110 (poor) | 30 | Not occurred |
| Comparative Example 7 | T-B7 | 3 | 106 (poor) | 29 | Occurred (poor) |
| Comparative Example 8 | T-B8 | 2 | 108 (poor) | 32 | Not occurred |
| Comparative Example 9 | T-B9 | 25 (poor) | 92 | 10 (poor) | Occurred (poor) |

In each of the toners T-A1 to T-A9, toner particles each included a composite core and a shell layer covering a surface of the composite core. The composite core was a composite of a toner core and organic particles located on a surface of the toner core. The toner core contained a releasing agent having a carboxyl group. The organic particles contained a resin having a carboxyl group and a mass average molecular weight of at least 30,000 and no greater than 50,500 (see Table 1). The shell layer included a unit having a non-ring-opened oxazoline group. A non-ring-opened oxazoline group content of the toner (specifically, an amount of the non-ring-opened oxazoline group contained in 1 g of the toner as measured by gas chromatography-mass spectrometry) was at least 500 μmol and no greater than 1,400 μmol (see Table 1). ΔH of the toner (specifically, an endothermic quantity due to melting of the releasing agent contained in 1 mg of the toner as measured by differential scanning calorimetry) was at least 80 mJ and no greater than 160 mJ (see Table 1). Therefore, the toners T-A1 to T-A9 were excellent in heat-resistant preservability and fixability as shown in Table 3.

What is claimed is:

1. A toner comprising toner particles, wherein the toner particles each include a composite core and a shell layer covering a surface of the composite core, the composite core is a composite of a toner core and organic particles located on a surface of the toner core, the toner core contains a releasing agent having a carboxyl group, the organic particles contain a resin having a carboxyl group and a mass average molecular weight of at least 30,000 and no greater than 50,500, the shell layer includes a unit having a non-ring-opened oxazoline group, an amount of the non-ring-opened oxazoline group contained in 1 g of the toner as measured by gas chromatography-mass spectrometry is at least 500 μmol and no greater than 1,400 μmol, and an endothermic quantity due to melting of the releasing agent contained in 1 mg of the toner as measured by differential scanning calorimetry is at least 80 mJ and no greater than 160 mJ.

2. The toner according to claim 1, wherein a temperature of the toner when a storage elastic modulus of the toner is $1.0\times10^8$ Pa is at least 70° C., and a temperature of the toner when the storage elastic modulus of the toner is $1.0\times10^5$ Pa is no higher than 85° C.

3. The toner according to claim 1, wherein a storage elastic modulus of the toner when a temperature of the toner is 130° C. is at least $1.0\times10^4$ Pa and no greater than $5.0\times10^4$ Pa.

4. The toner according to claim 1, wherein the shell layer includes a unit represented by a formula (A) shown below, (A)

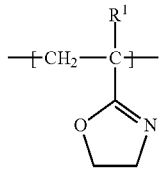

where in the formula (A), $R^1$ represents a hydrogen atom or an alkyl group optionally having a substituent.

5. The toner according to claim 4, wherein the shell layer further includes a unit represented by a formula (B1) shown below, (B1)

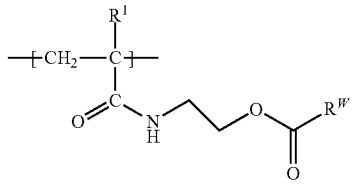

where in the formula (B1), $R^1$ represents the same chemical group as that represented by $R^1$ in the formula (A), and $R^W$ represents an atom of the releasing agent contained in the toner core.

6. The toner according to claim 4, wherein the shell layer further includes a unit represented by a formula (B2) shown below, (B2)

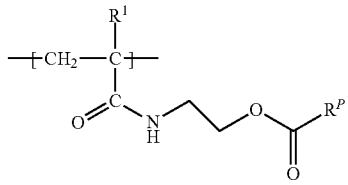

where in the formula (B2), $R^1$ represents the same chemical group as that represented by $R^1$ in the formula (A), and $R^P$ represents an atom of the resin contained in the organic particles.

7. The toner according to claim 4, wherein the shell layer further includes a unit represented by a formula (C) shown below, (C)

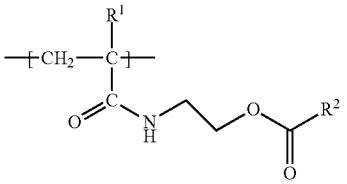

where in the formula (C), $R^1$ represents the same chemical group as that represented by $R^1$ in the formula (A), and $R^2$ represents an alkyl group optionally having a substituent.

8. The toner according to claim 4, wherein the shell layer contains a polymer of monomers including a compound represented by a formula (1) shown below and a (meth)acrylic acid alkyl ester, the releasing agent is an ester wax, and the resin contained in the organic particles is a polyester resin, (1)

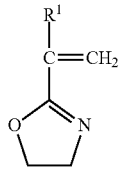

where in the formula (1), $R^1$ represents the same chemical group as that represented by $R^1$ in the formula (A).

9. The toner according to claim 1, wherein the toner has a glass transition point of at least 65° C. and no higher than 70° C.

10. The toner according to claim 1, wherein a proportion of an amount of the releasing agent relative to a mass of the toner cores is at least 60% by mass and no greater than 95% by mass.

11. The toner according to claim 1, wherein a proportion of an amount of the releasing agent relative to a mass of the toner cores is at least 90% by mass and no greater than 95% by mass, the toner cores further contain a colorant, and the toner cores contain no binder resin.

* * * * *